US008910729B2

(12) United States Patent
Park

(10) Patent No.: US 8,910,729 B2
(45) Date of Patent: Dec. 16, 2014

(54) METHOD AND APPARATUS FOR DRILLING LARGE-DIAMETER HOLE IN GROUND

(75) Inventor: Sun Keun Park, Seoul (KR)

(73) Assignee: Core Geotechnics Co., Ltd., Seoul (KR)

( * ) Notice: Subject to any disclaimer, the term of this patent is extended or adjusted under 35 U.S.C. 154(b) by 94 days.

(21) Appl. No.: 13/320,270

(22) PCT Filed: Apr. 14, 2010

(86) PCT No.: PCT/KR2010/002299

§ 371 (c)(1),
(2), (4) Date: Nov. 13, 2011

(87) PCT Pub. No.: WO2010/137798

PCT Pub. Date: Dec. 2, 2010

(65) Prior Publication Data

US 2012/0061145 A1 Mar. 15, 2012

(30) Foreign Application Priority Data

May 28, 2009 (KR) ..... 10-2009-0047054

(51) Int. Cl.

| | |
|---|---|
| ***E21B 7/00*** | (2006.01) |
| ***E21B 10/40*** | (2006.01) |
| ***E21B 6/00*** | (2006.01) |
| ***E21B 10/26*** | (2006.01) |

(52) U.S. Cl.

CPC . *E21B 10/40* (2013.01); *E21B 6/00* (2013.01); *E21B 10/26* (2013.01)

USPC ..... 175/57; 175/306; 175/334; 175/385; 175/386; 175/389; 175/390; 175/352; 175/414; 175/259; 175/75; 175/62; 173/1; 405/232

(58) Field of Classification Search

CPC ..... E21B 6/00; E21B 10/40; E21B 10/26

USPC ..... 175/306, 334, 385, 386, 389, 390, 57, 175/352, 414, 259, 75, 62; 405/249, 246, 405/245, 232, 231; 173/1, 90

See application file for complete search history.

(56) References Cited

U.S. PATENT DOCUMENTS

| | | | | |
|---|---|---|---|---|
| 2,054,255 | A * | 9/1936 | Howard | 175/298 |
| 2,994,389 | A * | 8/1961 | Le Bus, Sr. | 175/321 |
| 3,387,673 | A * | 6/1968 | Thompson | 175/96 |
| 6,073,947 | A * | 6/2000 | Gottschalk et al. | 280/124.128 |
| 6,827,162 | B2 * | 12/2004 | Fisher | 175/414 |
| 2005/0103527 | A1 * | 5/2005 | Church et al. | 175/62 |

FOREIGN PATENT DOCUMENTS

| | | |
|---|---|---|
| JP | 2006-336247 | 12/2006 |
| KR | 10-0145495 | 4/1998 |
| KR | 20-0123396 | 11/1998 |

(Continued)

*Primary Examiner* — Jennifer H Gay
*Assistant Examiner* — George Gray
(74) *Attorney, Agent, or Firm* — Novick, Kim & Lee, PLLC; Jae Youn Kim

(57) ABSTRACT

An apparatus for drilling a hole in the ground has a hammer drill installed at a bottom of a rod assembled in multi-stages at support structure on the ground. The hammer drill has a pilot hammer drill and a reamer hammer drill coupled to each other through a key structure formed in the vertical direction so as to allow simultaneous rotations and up-and-down movements relative to each other.

5 Claims, 12 Drawing Sheets

(56) References Cited

FOREIGN PATENT DOCUMENTS

| | | |
|---|---|---|
| KR | 20-0358948 | 8/2004 |
| KR | 10-0683021 | 2/2007 |
| KR | 10-2008-0064815 | 7/2008 |
| KR | 10-2009-0051684 | 5/2009 |

* cited by examiner

METHOD AND APPARATUS FOR DRILLING LARGE-DIAMETER HOLE IN GROUND

TECHNICAL FIELD

The present invention generally relates to a technique for drilling a hole in the ground using a hammer drill, and in particular to method and apparatus for drilling a large diameter hole in the ground which comprises one hammer drill including a pilot hammer drill and a reamer hammer drill coupled to each other through a key structure formed in the vertical direction so as to allow simultaneous rotation and up-and-down movement relative to each other, in which the hammer drill is made to rotate so as to first drill a pilot hole to a predetermined depth using the pilot hammer drill, followed by enlarging of the hole to a large diameter using the reamer hammer drill, so that a hole of extra large diameter which has not been possible to drill using a single conventional hammer can be drilled, and a large diameter hole can be drilled using a relatively small drilling machine, thereby providing the effects of reducing the time required to drill holes, facilitating drilling operations and maintaining a higher level of hole verticality.

BACKGROUND ART

In general, groundwork for civil engineering projects, construction works and the like involves work for preventing ground subsidence so that structures to be constructed on the ground can be structurally sturdily built. For such work, drilling operations are carried out for installing piles or beams into the ground or rock.

As a widely known apparatus for drilling a hole in the ground, FIG. 1(*a*) shows an apparatus for drilling a hole in the ground for installing a pile or the like which supports all the structures to be built mainly on the ground. Such an apparatus generally comprises a crawler travel device (100), a support arm (101) propped vertically by the crawler travel device, a drill machine or an auger machine (103) installed at the upper part of the support arm (101) for moving up and down, a rod (104) assembled at the auger machine (103) in multi-stages depending on the depth of a hole to be drilled, a hammer (105) attached to the bottom of the rod (104) to provide the power, or rotational force and impact, for drilling a hole in the ground, and a drill bit (106) installed at the hammer (105) for actually drilling a hole in the ground with the power provided by the hammer (105). The hammer (105) has a variety of sizes depending on the diameter of a hole to drilled, and though one drill bit (106) is normally installed at the bottom of the hammer (105), two or more hammers (105) and drill bits (106) can be mounted to drill a large diameter hole.

Recently, the increased large-scale civil engineering projects and construction works such as long bridges, highways, high-speed railroads, mega skyscrapers and the like require more large diameter holes to be drilled than ever. Thus, there is a great need for a technique for drilling a hole, which can maintain a high level of hole verticality and enhance work efficiency even when drilling a large diameter hole.

In order to meet such a need, various methods for drilling a large diameter hole in the ground have been proposed.

For example, Korean Patent Registration No. 10-0145495 (Date of Registration: Apr. 30, 1998) "Method and Device for Digging Ground by Combining Multi Hammer Auger Machine and Single Hammer Auger Machine" discloses an apparatus comprising a multi-hammer drill (210) and a single-hammer drill (220) concentrically coupled to each other, as shown in FIG. 2. According to the patent, the single-hammer drill (220) at the center is lowered to drill a small diameter hole using a drill bit (220*a*) of the single-hammer drill (220) as shown in FIG. 2(*a*), followed by enlarging the hole using a drill bit (210*a*) of the multi-hammer drill (210) installed outside the single-hammer drill (220). However, this technique requires two driving apparatus for separately controlling the operations of the single-hammer drill (220) at the center and the outside multi-hammer drill (210), thereby increasing the system complexity of the apparatus. In addition, in the technique described above, the multi-hammer drill (210) needs to remain stationary whenever the single-hammer drill (220) operates, and the single-hammer drill (220) should remain immobilized whenever the multi-hammer drill (210) operates. To this end, it is necessary to have a bearing structure between the multi-hammer drill (210) and the single hammer drill (220), which not only endures the impact caused by vibrations during the drilling and the impact from various dust and debris generated during the drilling process but also allows relative rotation and up-and-down movement relative to each other, though the above patent publication does not disclose it in the detailed description thereof. However, since such a bearing structure is hardly possible to manufacture because it demands extremely high precision, and if possible, the price is almost prohibitive, it is very difficult to actually implement such a technique.

Thus, it is rather common to use a single-hammer drill or a multi-hammer drill alone in turn depending on a drilling operation required, as described in the patent publication of Korean Patent Registration No. 10-0683021 (Date of Registration: Feb. 8, 2007) "Large-Caliber Excavator for Excavating Ground and Method thereof". As shown in FIG. 3 attached herein, a single-hammer drill of small diameter is used to first drill a pilot hole (330) having a small diameter of w and then is lifted up, so that a multi-hammer drill (320) of large diameter is used to enlarge the hole to a large diameter of W(>w). However, such a technique has a drawback in that it needs substantially increased time to drill a deep hole. In addition, it may be very difficult to proceed the drilling if the rock under the ground collapses. In order to reach a deep location under the ground (such as 10 m below ground) using the single-hammer drill and the multi-hammer drill, the rods (104) need to be assembled in multi-stages (for instance, four rods of a length of 3 m). Accordingly, the single-hammer drill is first assembled at the bottom of the rod (104) to drill a pilot hole to a depth of 3 m, and then another rod is assembled at the top of the rod (104) to extend the length thereof. Thereafter, the single-hammer drill at the bottom of the extended rod (104) is used to drill the pilot hole (330) to another 3 m, thereby making a hole drilled to a depth of 6 m. Such a process is repeated until the hole reaches a desired depth. After the pilot hole (330) of the desired depth is completed through the above process, the rods (104) are disassembled again to make it short, and then the multi-hammer drill is assembled at the bottom of the rod and is lowered to enlarge the hole. Similarly, another rod(s) of a length of 3 m is (are) assembled to extend the total length of the rods so as to enlarge the hole depending on the depth as in the case of the single-hammer drill. Such a process is repeated to enlarge the hole to the desired depth. According to this method, for instance, in order to drill a hole of a depth of 10 m, the process of assembling the rods of a length of 3 m is repeated eight times (four times×two hammer drills). Thus, there exist problems in that the drilling operation slows down and the cost thereof increases because of the time and labor required for each assembly and disassembly of the rods, thereby increasing the chance of machine malfunction caused by errors during the assembly, and making it difficult to maintain the straightness of the hole to be drilled.

Therefore, there still exists a need for a technique for drilling a large diameter hole in the ground, which can not only precisely maintain the verticality of a large diameter hole during the drilling of the hole but also cut down the time required for drilling, and can facilitate the drilling operation.

DISCLOSURE

Technical Problem

Thus, the present invention is designed to improve the above-described prior art technique for drilling a large diameter hole in the ground and present a variety of advantages thereof, and it is an object of the present invention in particular to provide novel method and apparatus for drilling a large diameter hole in the ground, which comprises a hammer drill including a pilot hammer drill and a reamer hammer drill coupled to each other through a key structure formed in the vertical direction so as to allow simultaneous rotation and up-and-down movement relative to each other, and in which the hammer drill is made to rotate so as to first drill a pilot hole of small diameter to a predetermined depth using the pilot hammer drill, followed by enlarging the hole to a large diameter using the reamer hammer drill, so that a high level of the verticality of a large diameter hole can be precisely maintained during the drilling, and it is possible to cut down the time required for the drilling and to facilitate the drilling operation, thereby providing a mechanically sturdy structure to a drilling machine.

Technical Solution

The above object is achieved by the method and apparatus for drilling a large diameter hole in the ground according to the present invention.

According to an aspect of the present invention, a method for drilling a large diameter hole in the ground, is characterized in that a hammer drill installed at the bottom of a rod assembled in multi-stages at support means on the ground comprises a pilot hammer drill and a reamer hammer drill coupled to each other through a key structure formed in the vertical direction so as to allow simultaneous rotation and up-and-down movement relative to each other, and in that in a drilling operation, a repetition is made such that the hammer drill is made to rotate and the pilot hammer drill is first lowered to drill a pilot hole of small diameter (w) to a predetermined depth (d) and is lifted up to original position, and then the reamer hammer drill is lowered to enlarge the hole to a large diameter (W) down to the predetermined depth (d).

According to an embodiment of the present invention, during the drilling of the pilot hole of small diameter, a plurality of rollers at the bottom of the reamer hammer drill remain lowered such that at least one drill bit installed at and extended from the bottom of the reamer hammer drill is located above the rollers so as to prevent the at least one drill bit from directly contacting soil below them.

According to another aspect of the present invention, a method for drilling a large diameter hole in the ground, is characterized in that a hammer drill installed at the bottom of a rod assembled in multi-stages at support means on the ground comprises a pilot hammer drill and a reamer hammer drill coupled to each other through a key structure formed in the vertical direction so as to allow simultaneous rotation and up-and-down movement relative to each other, and in that in a drilling operation, a repetition is made such that the hammer drill is made to rotate and the pilot hammer drill and the reamer hammer drill are first simultaneously driven to drill a large diameter hole in the ground, the pilot hammer drill stops working temporarily when a positional difference between the pilot hammer drill and the reamer hammer drill reaches a predetermined value, and the pilot hammer drill which has stopped working temporarily starts working again to drill a small diameter hole when the positional difference between the pilot hammer drill and the reamer hammer drill reaches zero during the drilling of the hole.

According to yet another aspect of the present invention, an apparatus for drilling a large diameter hole in the ground comprises a hammer drill installed at the bottom of a rod assembled in multi-stages at support means on the ground, wherein the hammer drill comprises: a pilot hammer drill comprising at least one set of a hammer and a drill bit attached to the hammer, and a hammer drill frame for fixing the at least one set of the hammer and the drill bit attached to the hammer; a reamer hammer drill comprising at least one set of a hammer and a drill bit attached to the hammer, and a hammer drill frame for fixing the at least one set of the hammer and the drill bit attached to the hammer, the reamer hammer drill being installed concentrically around and spaced apart from the pilot hammer drill; and a key structure extended in the vertical direction for fixing the pilot hammer drill and the reamer hammer drill so as to rotate simultaneously each other and for coupling the pilot hammer drill and the reamer hammer drill along the length thereof so as to move up and down relatively.

According to another embodiment of the present invention, the reamer hammer drill is provided with a plurality of rollers at the bottom thereof for moving up and down.

According to yet another embodiment of the present invention, the rollers provided at the bottom of the reamer hammer drill are configured to move up and down by means of bellows, respectively.

According to still another embodiment of the present invention, the apparatus for drilling a large diameter hole in the ground further comprises one or more of reamer hammer drills coupled to the outer perimeter of the reamer hammer drill by means of another key structure extended in the vertical direction for fixing the pilot hammer drill and the reamer hammer drill so as to rotate simultaneously each other and for coupling the pilot hammer drill and the reamer hammer drill along the length thereof so as to move up and down relatively. According to yet another embodiment of the present invention, a technique of discharging the excavated soil disclosed in "Drill Body with Air-Hammer for Inducing Reverse Circulation Effectively and Drilling Method Using the Same" (Korean Patent Application No. 10-2008-0064815) which describes separately a first air supply tube for driving an air hammer and a second air supply tube for inducing reverse circulation, may be applied to the present invention to effectively discharged the excavated soil.

Advantageous Effects

According to the present invention of the above constitution, since one hammer drill is constructed by comprising a pilot hammer drill and a reamer hammer drill coupled to each other through a key-guide structure in the vertical direction so as to allow simultaneous rotation and up-and-down movement relative to each other, there is an effect of providing a hammer drill capable of maintaining mechanical robustness even under the environment of vibration, dust, debris and the like generated during the drilling of a hole.

According to the present invention, since the pilot hammer drill and the reamer hammer drill rotate simultaneously, it is not necessary to install separate equipment for driving respectively the pilot hammer drill and the reamer hammer drill within the hammer drill, thereby simplifying the structure of the drilling machine and reducing the cost to manufacture the machine.

According to the present invention, while the rotating pilot hammer drill moves down relative to the reamer hammer drill and drills a pilot hole of small diameter to a predetermined depth using one or more drill bits installed at the bottom thereof, since one or more drill bits installed at the bottom of the reamer hammer drill rotating with the pilot hammer drill through the key structure can maintain a predetermined distance from the underground soil by means of rollers, there can be provided an effect of preventing the damage of the drill bits of the reamer hammer drill.

According to the present invention, for instance when drilling a large diameter hole to a depth of 10 m, since a pilot hole of small diameter is first drilled to a predetermined depth, for example around 0.5 m, then the hole is enlarged for the predetermined depth, and these processes are repeated multiple times (for example, 20 times) to drill a deep hole of large diameter, there can be provided an effect of precisely maintaining the verticality of a large diameter hole. In addition, since it is possible to reduce the time to assemble and disassemble multi-stage rods required for inserting a hammer drill along a deep hole, the time for drilling operation reduces and the drilling operation can be simplified, thereby reducing the total cost for the drilling operation.

| | |
|---|---|
| 40: hammer drill | 41: reamer hammer drill |
| 42: key | 43: key guide |
| 44: pilot hammer drill | 45: reverse circulation pipe(in-let) |
| 46, 48: hammer | 47, 49: drill bit |
| 50: rollers | |
| 51: bellows or air/hydraulic cylinder | |
| 52: fixing frame | |

BEST MODE

Hereinafter, the present invention will be described by way of specific embodiments with reference to accompanying drawings.

Figure 1A:
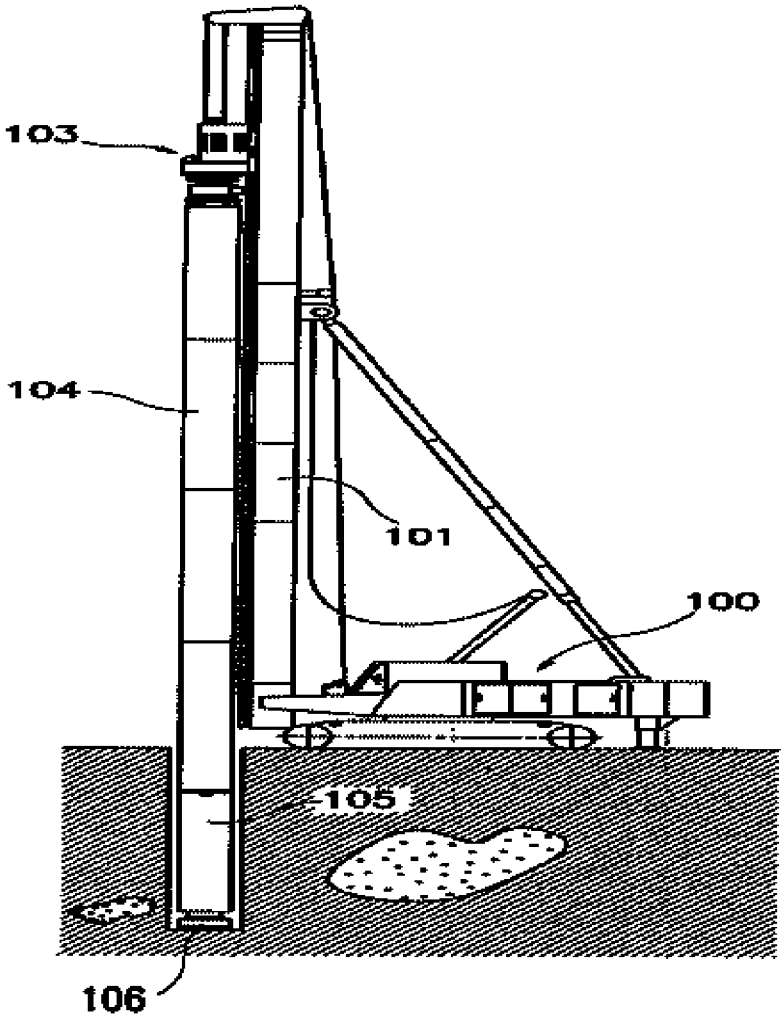
Fig. 1A Prior Art
FIGS. 1 to 3 are schematic diagrams to illustrate the principle of method and apparatus for drilling a large diameter hole according to prior art.
Figure 1B:
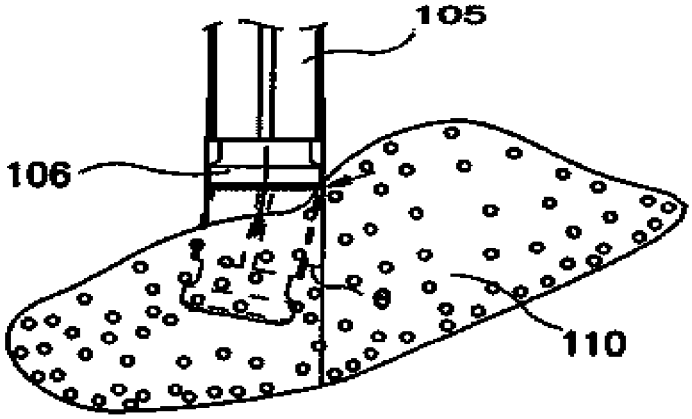
Fig. 1B Prior Art
Figure 2A:
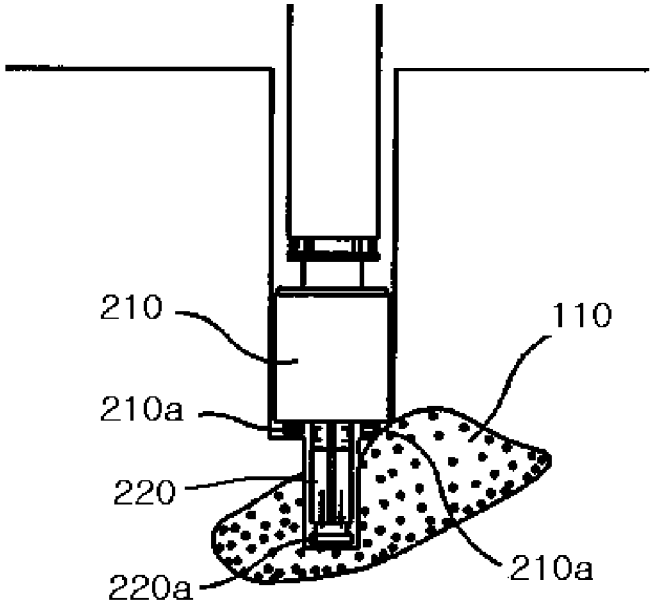
Fig. 2A Prior Art
Figure 2B:
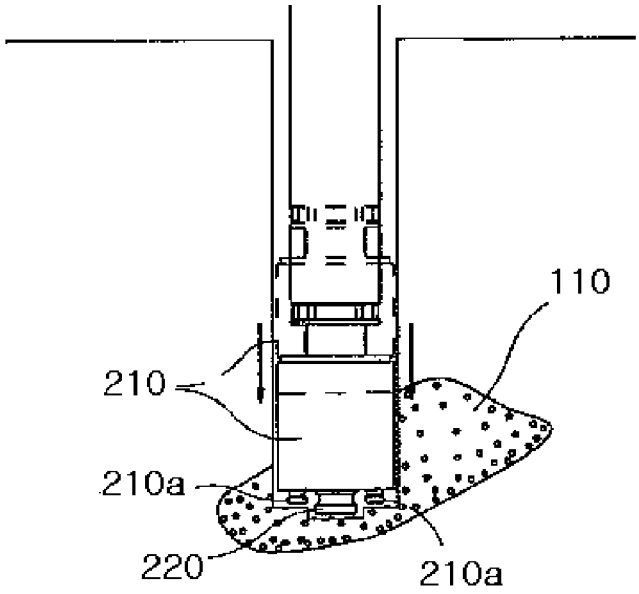
Fig. 2B Prior Art
Figure 3:
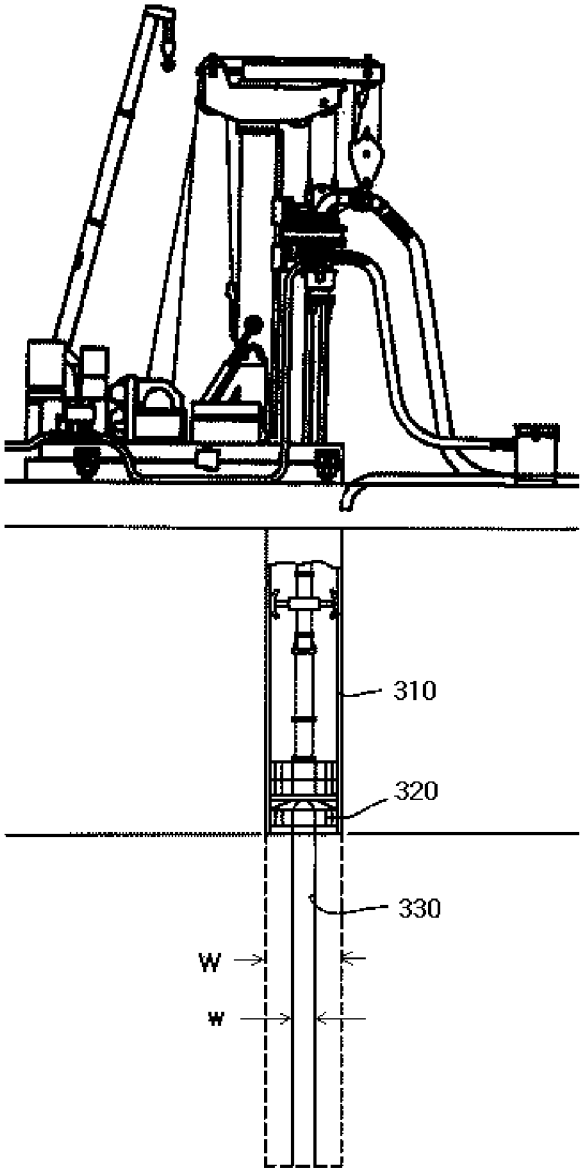
Fig. 3 Prior Art
Figure 4:
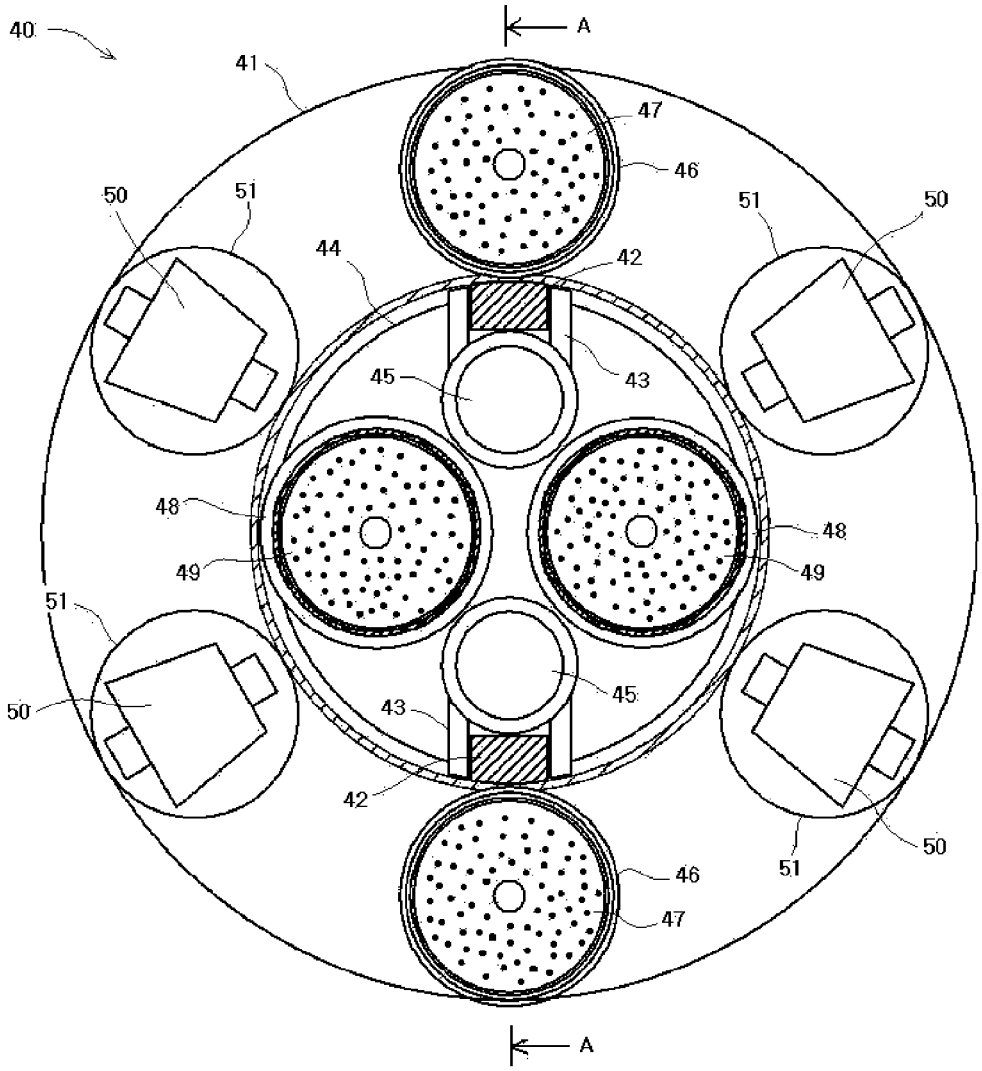
FIG. 4 is a schematic bottom plan view of an apparatus for drilling a large diameter hole according to an embodiment of the present invention.
Figure 5:
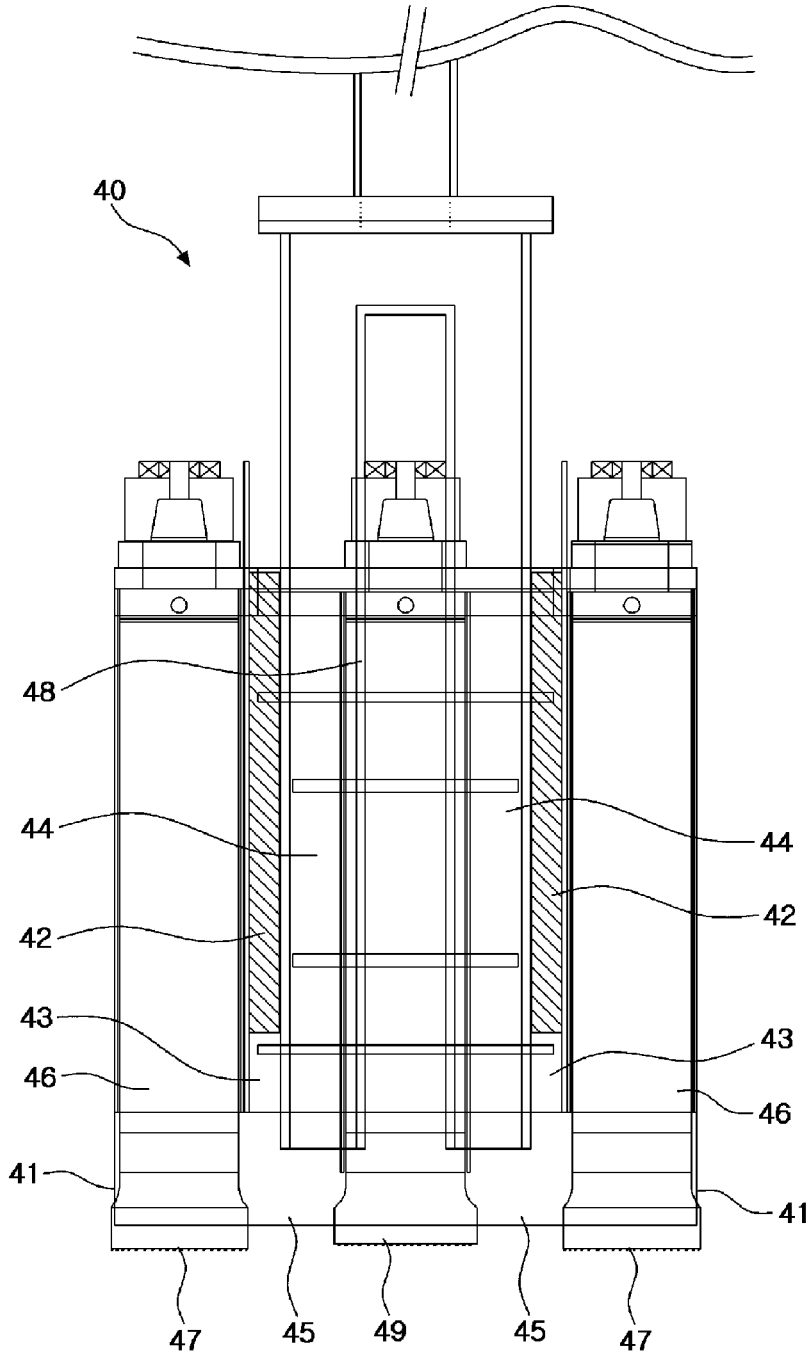
FIG. 5 is a schematic side view illustrating one side of the hammer drill along section A-A.
Figure 6:
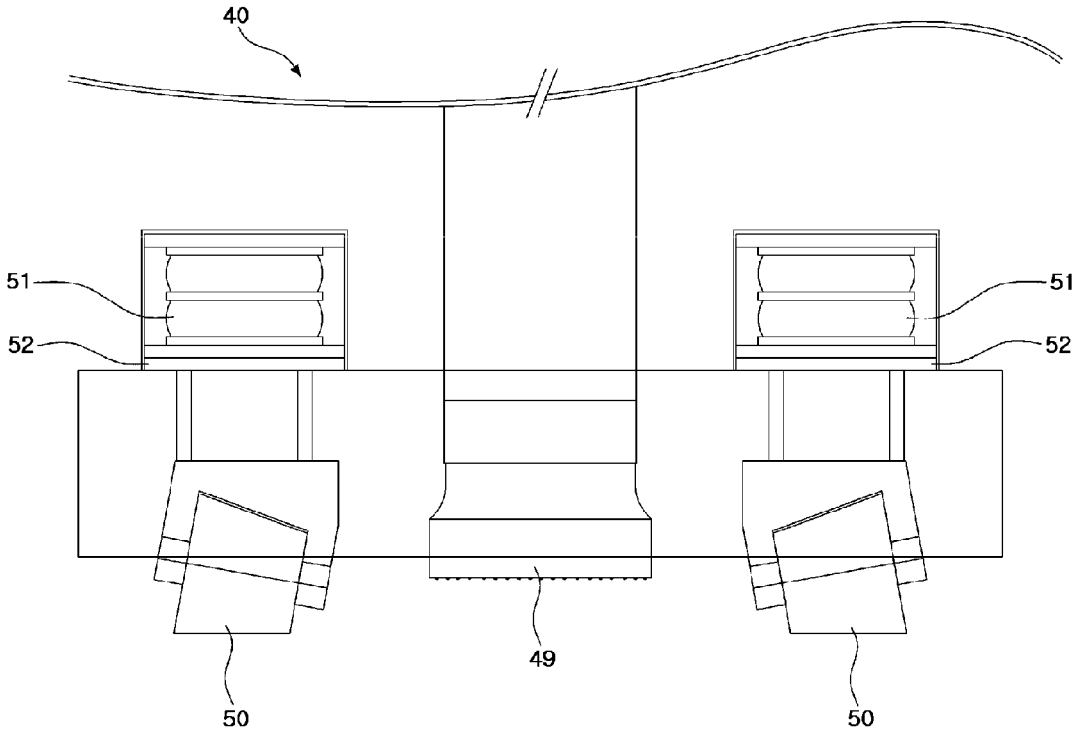
FIG. 6 is a schematic side view demonstrating the position of rollers among the components in FIG. 5.
Figure 7:
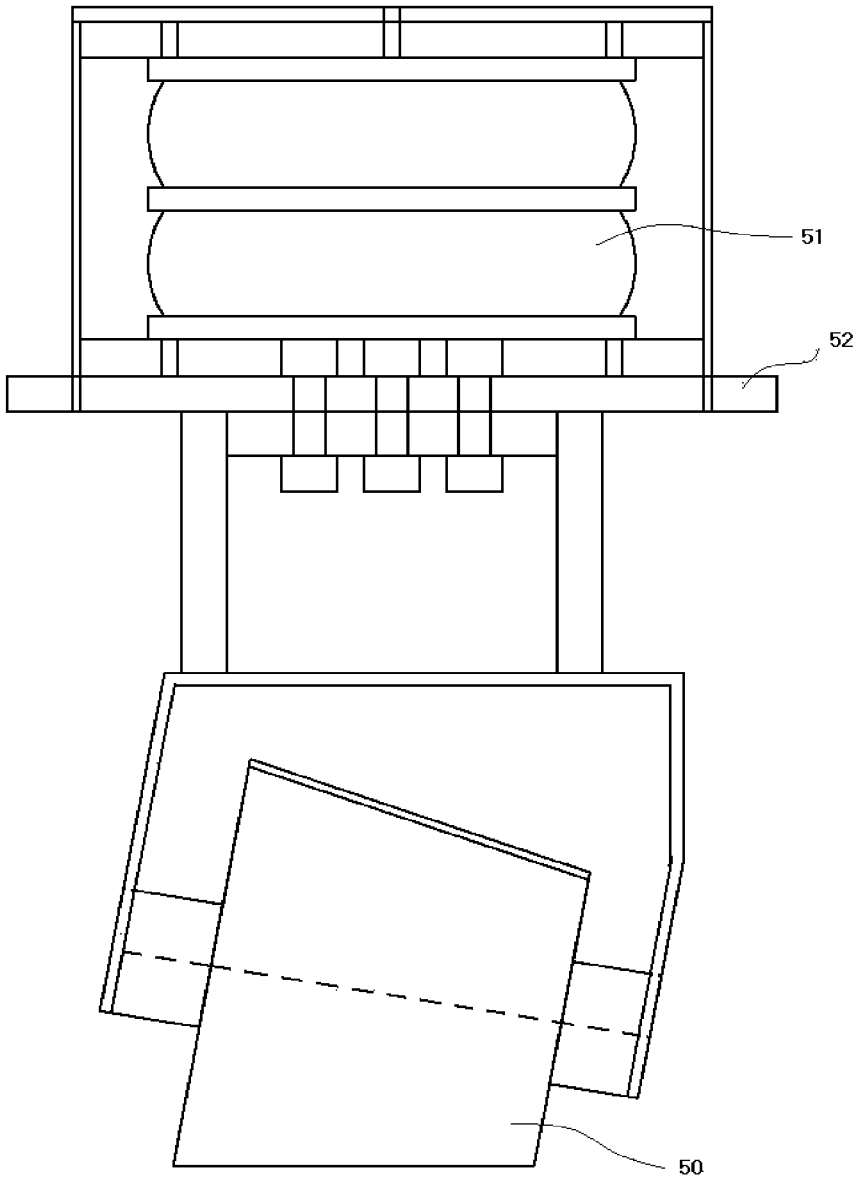
FIG. 7 is a schematic side view illustrating the structure of the rollers of the embodiment in FIG. 4, FIGS. 8 and 9 schematically demonstrate the process of drilling a pilot hole of small diameter and the process of enlarging the hole to a large diameter of the method for drilling a large diameter hole according to an embodiment of the present invention.

FIGS. 4 to 7 are schematic views illustrating the constitution of an apparatus for drilling a large diameter hole according to an embodiment of the present invention, and FIGS. 8 to 12 are drawings for demonstrating a method for drilling a large diameter hole according to an embodiment of the present invention. An apparatus for drilling a hole according to the present invention comprises a hammer drill (40) installed at the bottom of a rod (104) assembled in multi-stages at support means on the ground, as FIG. 4 shows the bottom structure thereof and FIGS. 5 and 6 show the side view thereof.

The hammer drill (40) comprises a pilot hammer drill (44, 48, 49), a reamer hammer drill (41, 46, 47) installed concentrically around and spaced apart from the pilot hammer drill (44, 48, 49), and a key structure (42, 43) for fixing the pilot hammer drill (44, 48, 49) and the reamer hammer drill (41, 46, 47) in the direction of rotation and for coupling the drills so as to slidingly move up and down.

The pilot hammer drill (44, 48, 49) comprises at least one set of a hammer (48) and a drill bit (49) attached to the hammer (48), and a hammer drill frame (44) for fixing the at least one set of the hammer (48) and the drill bit (49) attached to the hammer (48). An embodiment shown in FIG. 4 illustrates two sets of the hammer (48) and the drill bit (49) installed at the hammer drill frame (44) of the pilot hammer drill (44, 48, 49). In addition, the pilot hammer drill (44, 48, 49) may be provided with a reverse circulation pipe(in-let) (45) for discharging soil and rock debris generated during the drilling of a hole outside the hole. The reamer hammer drill (41, 46, 47) has an annular cross section so as to rotate around the pilot hammer drill (44, 48, 49) at the center thereof, and comprises at least one set of a hammer (46) and a drill bit (47) attached to the hammer (46), and a hammer drill frame (41) for fixing the at least one set of the hammer (46) and the drill bit (47) attached to the hammer (46). In addition, the reamer hammer drill (41, 46, 47) is installed concentrically around and spaced apart from the pilot hammer drill (44, 48, 49).

In the embodiment shown in the drawings, though the structure comprising one reamer hammer drill (41, 46, 47) is illustrated, the scope of the present invention is not limited to this. As shown by a broken line in FIG. 10, it is self-explanatory that another reamer hammer drill wrapping around the outside of the reamer hammer drill may be coupled to the outer perimeter of the reamer hammer drill by means of another key structure.

In an embodiment, the bottom part of the reamer hammer drill (41, 46, 47) may be further provided with a desired number of rollers (50) in addition to one or more drill bits (47). These rollers (50) are installed so as to move up and down. In addition, the rollers (50) are fixed to the hammer drill frame (41) by means of a fixing frame (52), and may be lowered so as to extend from the bottom of the hammer drill frame (41) or be lifted up to original position by means of a hydraulic or pneumatic cylinder or bellows (51).

The key structure (42, 43) is extended in the vertical direction, for fixing the pilot hammer drill (44, 48, 49) and the reamer hammer drill (41, 46, 47) so as to rotate simultaneously together in the direction of rotation and for coupling the drills along the length thereof so as to move up and down relatively. In an embodiment shown in the drawings, a key guide (43) in the form of a groove extended in the vertical direction is installed at the hammer drill frame (44) of the pilot hammer drill, and a key (42) in the form of a ridge raised in the vertical direction is installed at the hammer drill frame (41) of the reamer hammer drill. Alternatively, it is also possible to have a structure that a key (42) in the form of a ridge raised in the vertical direction is installed at the hammer drill frame (44) of the pilot hammer drill and a key guide (43) in the form of a groove extended in the vertical direction is installed at the hammer drill frame (41) of the reamer hammer drill.

Furthermore, the hammer drill (40) of the present invention comprises a base frame on which the pilot hammer drill (44, 48, 49) and the reamer hammer drill (41, 46, 47) are mounted, and on top of the base frame there may be provided with a stopper for checking the upward movement of the key (42) when the reamer hammer drill (41, 46, 47) and the pilot hammer drill (44, 48, 49) move up and down relative to each other. In addition, a passage for supplying pressurized air to respective hammers (46, 48) and a discharge passage for discharging the excavated soil and rock debris outside the hole are formed inside the hammer drill (40). The passage for supplying pressurized air are formed separately at the hammer (46) on the reamer hammer drill (41, 46, 47) side and at the hammer (48) on the pilot hammer drill (44, 48, 49) side. Furthermore, the present invention may further comprise a drive apparatus for rotating the hammer drill (40).

Figure 8:
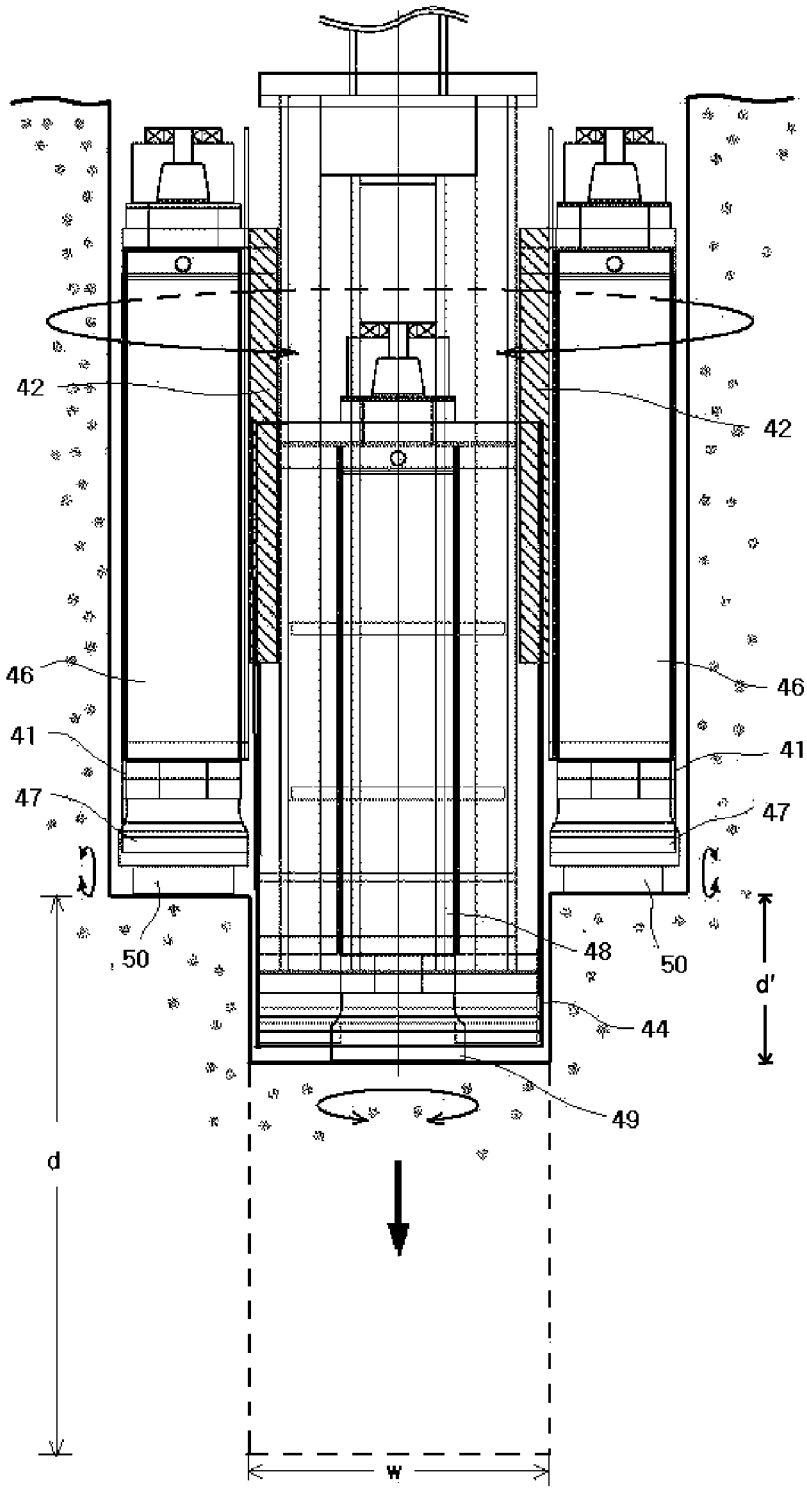
Figure 9:
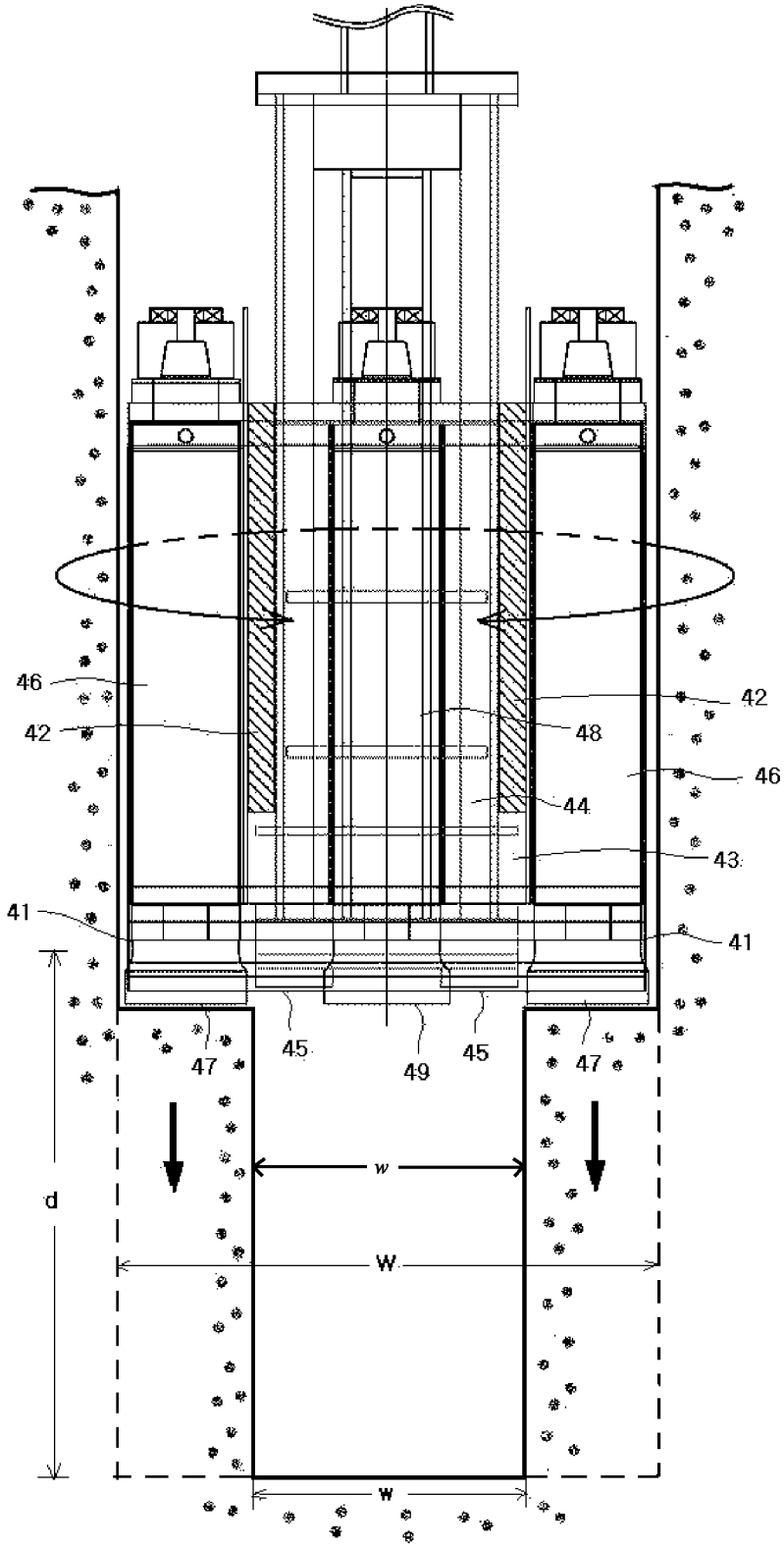
Figure 10:
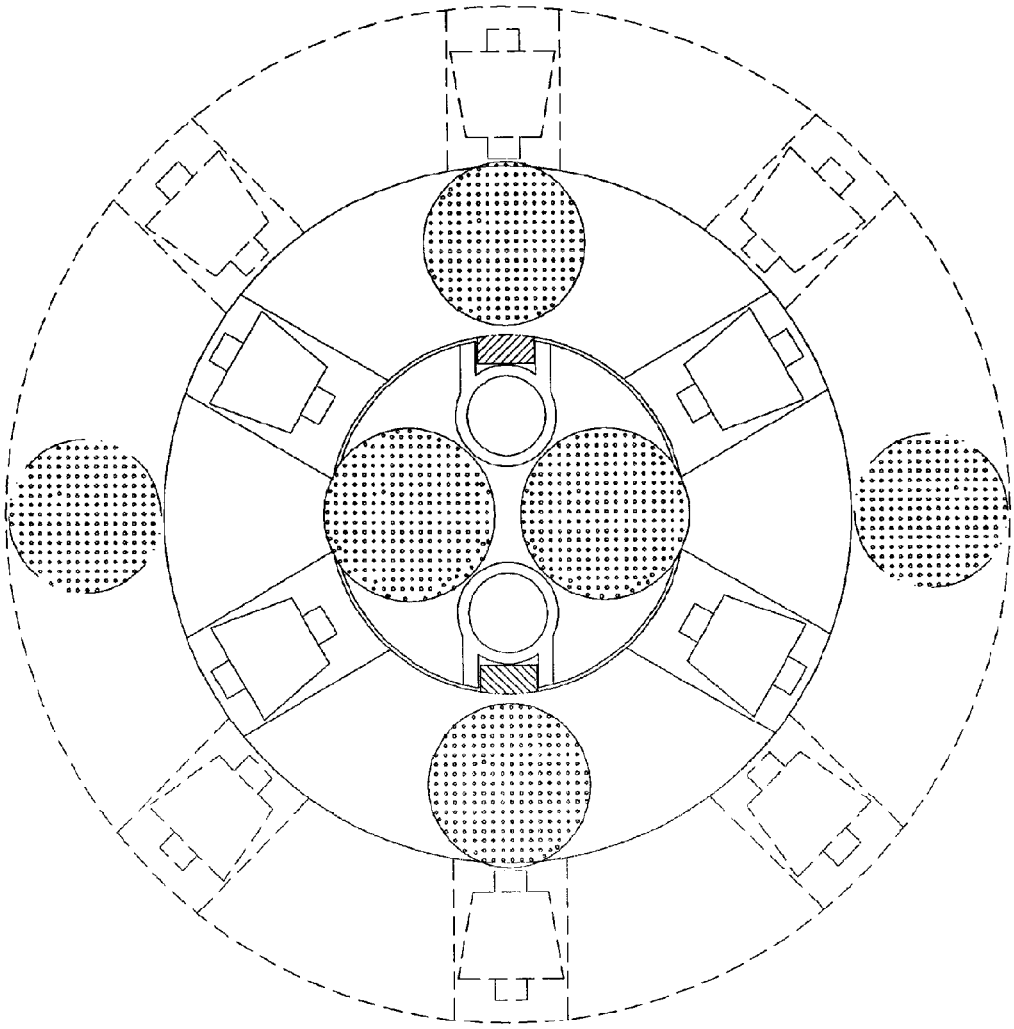
FIG. 10 is a schematic side view illustrating the side of a reamer hammer drill installed at the outer perimeter of the reamer hammer drill in FIG. 5 by means of another key structure.
Figure 11:
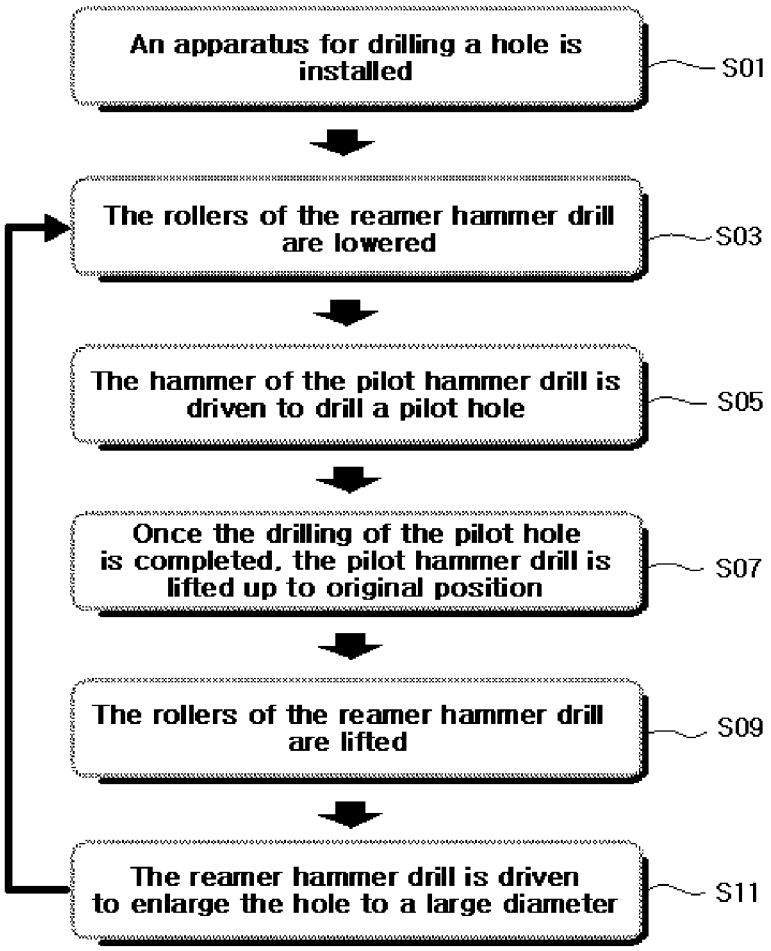
FIG. 11 is a flowchart schematically depicting each step of a method for drilling a large diameter hole according to an embodiment of the present invention.

A method for drilling a large diameter hole according to the present invention may proceed as shown in FIGS. 8 and 9, using the apparatus comprising the hammer drill (40) constructed as above.

In a detailed description, the apparatus for drilling a hole is installed (S01). Then, in a drilling operation, a pilot hole of small diameter (w) is first drilled to a predetermined depth (d), followed by enlarging the hole to a large diameter (W) for the predetermined depth.

First, the bellows is activated so that the plurality of rollers remain lowered below the bottom of the reamer hammer drill (41, 46, 47). Accordingly, the drill bits (47) installed at the bottom of the reamer hammer drill (41, 46, 47) are located above the rollers (50), thereby preventing the drill bits (47) from directly contacting soil below them (S03).

In this state, the hammer drill (40) is made to rotate and the pilot hammer drill (44, 48, 49) is lowered to drill a pilot hole of small diameter (w) to a predetermined depth (d) (S05). At this time, the pressurized air is supplied to the hammer (48) of the pilot hammer drill (44, 48, 49) only, so that only the drill bit (49) of the pilot hammer drill (44, 48, 49) performs impact drilling operation. Once the pilot hole of small diameter (w) is completed to the predetermined depth (d), the pilot hammer drill (44, 48, 49) is lifted up to original position (S07). Now, in order to enlarge the hole to a large diameter, the bellows is activated to lift up the plurality of rollers to original position which have been lowered below the bottom of the reamer hammer drill (41, 46, 47). Accordingly, the drill bits (47) installed at the bottom of the reamer hammer drill (41, 46, 47) are located below the rollers (50) and can directly contact the soil to be drilled (S09). Next, the reamer hammer drill (41, 46, 47) is lowered to enlarge the hole to a large diameter (W) for the predetermined depth (d) (S11). At this time, the pressurized air is supplied to the hammer (47) of the reamer hammer drill (41, 46, 47) only, so that only the reamer hammer drill (41, 46, 47) performs impact enlargement operation.

When the hole is completed to the predetermined depth (d) in this way, the step (S03) for drilling a pilot hole of small diameter (w) to a predetermined depth (d) to the step (S11) for enlarging the hole to a large diameter using the reamer hammer drill are repeated again, thereby drilling a large diameter hole to a desired depth.

The above method is for drilling a pilot hole of small diameter first and then for enlarging the hole to a large diameter. The method for drilling a hole according to the present invention is not limited to the above method, but may proceed to drill a small diameter hole and enlarge it to a large diameter at the same time. This procedure is illustrated in the flowchart of FIG. 12.

Figure 12:
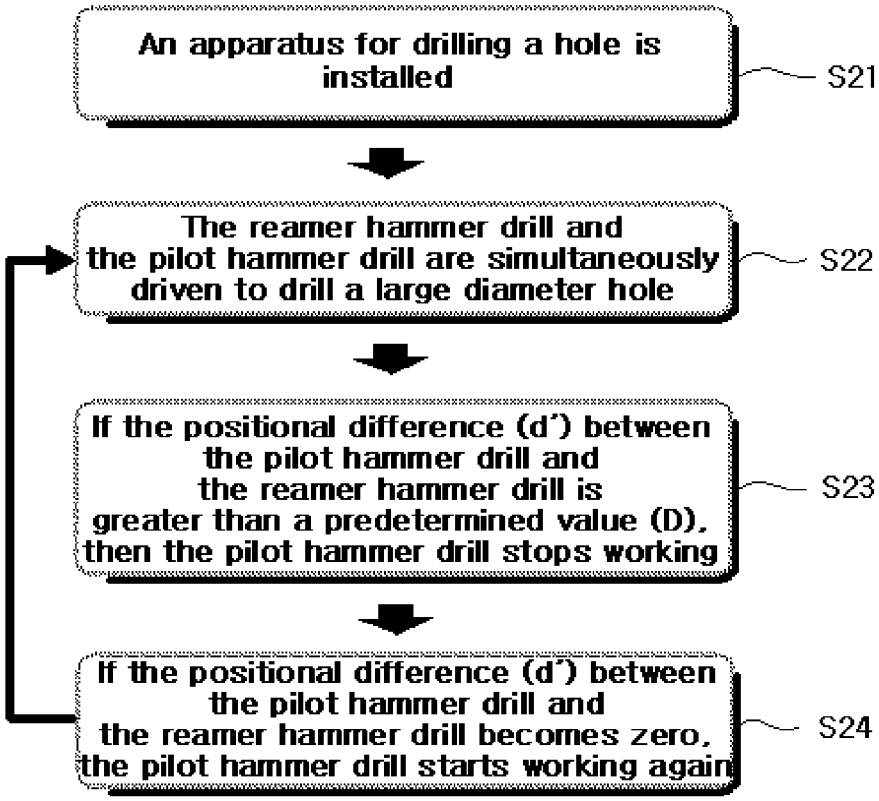
FIG. 12 is a flowchart schematically depicting each step of a method for drilling a large diameter hole according to another embodiment of the present invention.

With reference to FIG. 12, the apparatus for drilling a hole is installed (S21). Then, the hammer drill (40) is made to rotate and the pilot hammer drill (44, 48, 49) and the reamer hammer drill (41, 46, 47) are simultaneously driven to drill a hole of large diameter (W) (S22).

In this case, the forward movement of the pilot hammer drill having a small diameter tends to proceed further compared with the forward movement of the reamer hammer drill having a large diameter. This is because the area to be drilled by the pilot hammer drill having a small diameter is much smaller than the area to be drilled by the reamer hammer drill having a large diameter for the same time of operation. Accordingly, the pilot hammer drill moves further down than the reamer hammer drill during the drilling, thereby causing a positional difference (d') therebetween.

Thus, the positional difference (d') between the pilot hammer drill (44, 48, 49) and the reamer hammer drill (41, 46, 47) reaches a predetermined value (D) during the drilling of the hole, in this case the pilot hammer drill (44, 48, 49) stops working temporarily, and only the reamer hammer drill continues drilling (S23).

Thereafter, the reamer hammer drill (41, 46, 47) continues drilling while the pilot hammer drill (44, 48, 49) stops working, and when the positional difference (d') therebetween reaches zero, the pilot hammer drill (44, 48, 49) which has stopped working temporarily starts working again to drill a small diameter (w) hole (S24).

When the hole is completed to a predetermined depth (D), the step (S22) for simultaneously driving the reamer hammer drill and the pilot hammer drill to the step (S24) for making the pilot hammer drill which has stopped working temporarily work again are repeated, thereby drilling a large diameter hole to a desired depth.

The present invention has been described in detail with reference to specific embodiments thereof, but it will be understood that variations and modifications can be effected by those skilled in the art without departing from the spirit and scope of the disclosure. Therefore, it is noted that the scope of the invention is not limited by the embodiments described, but by accompanying claims

INDUSTRIAL APPLICABILITY

As described above, the method and apparatus for drilling a large diameter hole in the ground of a continuous enlargement type may be widely applied to drilling or excavation operations for insertion of beams or piles into the ground or rock so that structures to be built on the ground can be sturdily installed during the groundwork for civil engineering projects, construction works and the like.

The invention claimed is:

1. A method for drilling a hole in the ground, the method comprising:

installing a hammer drill on a drilling apparatus, the hammer drill comprising a pilot hammer drill and a reamer hammer drill coupled to each other through a key structure disposed therebetween and in the vertical direction, the key structure being configured to allow the pilot and reamer hammer drills to simultaneously rotate, and to move up and down relative to each other and simultaneously with the rotation of the pilot and reamer hammer drills;

lowering the pilot hammer drill to drill a pilot hole to a predetermined depth, the pilot hole having a smaller diameter than that of the hole;

lifting up the pilot hammer drill to an original position; and lowering the reamer hammer drill to drill the hole, enlarging the pilot hole to a larger diameter, to the predetermined depth, wherein the pilot hammer drill includes at least one reverse circulation pipe configured to discharge soil and rock debris generated during the drilling of the hole outside the hole, and an end of the at least one reverse circulation pipe is located on a bottom of the hammer drill.

2. The method of claim 1, further comprising lowering a plurality of rollers attached at a bottom of the reamer hammer drill and remaining the lowered plurality of rollers during the drilling of the pilot hole such that at least one drill bit installed at and extended from the bottom of the reamer hammer drill is located above the plurality of rollers so as to prevent the at least one drill bit from directly contacting soil below them.

3. An apparatus for drilling a hole in the ground, the apparatus comprising:

a hammer drill installed at a bottom of a rod assembled in multi-stages at a support on the ground, wherein the hammer drill comprises:

a pilot hammer drill including at least one set of a first hammer and a first drill bit attached to the first hammer, and a first hammer drill frame for fixing the at least one set of the first hammer and the first drill bit attached to the first hammer;

a reamer hammer drill including at least another set of a second hammer and a second drill bit attached to the second hammer, and a second hammer drill frame for fixing the at least another set of the second hammer and the second drill bit attached to the second hammer, the reamer hammer drill being installed concentrically around and spaced apart from the pilot hammer drill; and a key structure extended in the vertical direction, configured to fix the pilot hammer drill and the reamer hammer drill so as to rotate simultaneously each other and configured to couple the pilot hammer drill and the reamer hammer drill along the length thereof so as to move up and down relative to each other and simultaneously with the rotation of the pilot and reamer hammer drills, wherein the reamer hammer drill includes a plurality of rollers attached at a bottom thereof and configured to move up and down, and wherein the reamer hammer drill further includes a plurality of bellows configured to move up and down the plurality of rollers, respectively.

4. The apparatus of claim 3, further comprising another reamer drill coupled to the outer perimeter of the reamer hammer drill by another key structure extended in the vertical direction for fixing the reamer hammer drill and the another reamer hammer drill so as to rotate simultaneously each other and for coupling the reamer hammer drill and the another reamer hammer drill along the length thereof so as to move up and down relative to each other.

5. The apparatus of claim 3, wherein the pilot hammer drill includes at least one reverse circulation pipe configured to discharge soil and rock debris generated during the drilling of the hole outside the hole, and an end of the at least one reverse circulation pipe is located on a bottom of the hammer drill.

* * * * *